US011605486B2

(12) United States Patent
Hirama

(10) Patent No.: US 11,605,486 B2
(45) Date of Patent: Mar. 14, 2023

(54) INDUCTOR

(71) Applicant: Murata Manufacturing Co., Ltd., Kyoto-fu (JP)

(72) Inventor: Yoshiaki Hirama, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 361 days.

(21) Appl. No.: 16/897,199

(22) Filed: Jun. 9, 2020

(65) Prior Publication Data

US 2020/0388429 A1 Dec. 10, 2020

(30) Foreign Application Priority Data

Jun. 10, 2019 (JP) ..... JP2019-108077

(51) Int. Cl.
*H01F 27/29* (2006.01)
*H01F 17/04* (2006.01)
(Continued)

(52) U.S. Cl.
CPC ..... *H01F 17/045* (2013.01); *H01F 3/08* (2013.01); *H01F 27/02* (2013.01); *H01F 27/255* (2013.01);
(Continued)

(58) Field of Classification Search
CPC ..... H01F 17/045; H01F 3/08; H01F 27/02; H01F 27/255; H01F 41/0246;
(Continued)

(56) References Cited

U.S. PATENT DOCUMENTS

2009/0102589 A1* 4/2009 Lee ..... H01F 27/255 336/83
2010/0259353 A1* 10/2010 Saito ..... H01F 27/327 336/205
(Continued)

FOREIGN PATENT DOCUMENTS

CN 101086916 A 12/2007
CN 201188341 Y 1/2009
(Continued)

OTHER PUBLICATIONS

An Office Action; "Notice of Reasons for Refusal," mailed by the Japanese Patent Office dated Apr. 12, 2022, which corresponds to Japanese Patent Application No. 2019-108077 and is related to U.S. Appl. No. 16/897,199 with English language translation.
(Continued)

*Primary Examiner* — Tuyen T Nguyen
(74) *Attorney, Agent, or Firm* — Studebaker & Brackett PC

(57) ABSTRACT

An inductor includes an integrated preform having a coil installed thereinside. The coil includes extension portions extending from two stages of a spiral wound portion. The integrated preform is formed by bonding together first and second preforms. The first and/or second preform is shaped like a housing including a plate-shaped bottom, a wall provided around the periphery of the bottom portion, and two cut out portions provided in the wall. The extension portions extend to outside the integrated preform via the cut out portions. The difference between a first distance from a reference surface, which is the bottom surface of the bottom of the first or second preform, to a bottom surface of one cut out portion and a second distance from the reference surface to the bottom surface of the other cut out portion is substantially an integer multiple of the width of the flat wire.

20 Claims, 16 Drawing Sheets

(51) Int. Cl.

| | |
|---|---|
| ***H01F 27/02*** | (2006.01) |
| ***H01F 27/255*** | (2006.01) |
| ***H01F 41/02*** | (2006.01) |
| ***H01F 3/08*** | (2006.01) |

(52) U.S. Cl.
CPC ... *H01F 41/0246* (2013.01); *H01F 2017/046* (2013.01); *H01F 2017/048* (2013.01)

(58) Field of Classification Search
CPC ..... H01F 2017/046; H01F 2017/048; H01F 27/2852; H01F 27/292; H01F 17/04; H01F 27/306; H01F 27/00–40
See application file for complete search history.

(56) References Cited

U.S. PATENT DOCUMENTS

| | | | | |
|---|---|---|---|---|
| 2013/0307655 | A1 | 11/2013 | Saito et al. | |
| 2014/0068926 | A1* | 3/2014 | Saito ..... | H01F 41/127 29/602.1 |

FOREIGN PATENT DOCUMENTS

| | | | |
|---|---|---|---|
| CN | 206877818 | U | 1/2018 |
| JP | 2006-128473 | A | 5/2006 |
| JP | 2012-160507 | A | 8/2012 |
| JP | 2014-220292 | A | 11/2014 |
| JP | 2016-025179 | A | 2/2016 |
| JP | 2018-116985 | A | 7/2018 |

OTHER PUBLICATIONS

An Office Action mailed by China National Intellectual Property Administration dated Sep. 29, 2021 which corresponds to Chinese Patent Application No. 202010522142.X and is related to U.S. Appl. No. 16/897,199 with English language translation.

An Office Action; "Notice of Reasons for Refusal," mailed by the Japanese Patent Office dated Feb. 1, 2022, which corresponds to Japanese Patent Application No. 2019-108077 and is related to U.S. Appl. No. 16/897,199 with English language translation.

* cited by examiner

INDUCTOR

CROSS-REFERENCE TO RELATED APPLICATION

This application claims benefit of priority to Japanese Patent Application No. 2019-108077, filed Jun. 10, 2019, the entire content of which is incorporated herein by reference.

BACKGROUND

Technical Field

The present disclosure relates to an inductor.

Background Art

An element body of an inductor can be formed by installing a coil, which includes a wound portion (wound wire part) in which a conductor is wound in a plurality of stages and a pair of extension portions (lead parts) that extend from the wound portion, between two preforms and performing pressing. In general, one of the two preforms is a preform that is shaped substantially like a housing and two identically shaped cut out portions (lead out grooves) are arranged in the preform as a pair. The cut out portions are for allowing the leading ends of the extension portions to extend to outside the two preforms when the coil is installed between the two preforms, as described, for example, in Japanese Unexamined Patent Application Publication No. 2018-116985.

In an integrated preform formed by bonding together two preforms as disclosed in Japanese Unexamined Patent Application Publication No. 2018-116985, the two cut out portions are arranged at positions that are at identical distances from a reference surface (for example, the bottom surface of one of the preforms). When a coil having a pair of extension portions that extend from different stages of the wound portion, which is wound in a plurality of stages, is installed in an integrated preform in this manner, the arrangement state of the coil is unstable. Specifically, the winding center axis of the coil ends up in an inclined state with respect to the center axis of the integrated preform when one extension portion contacts a cut out portion and the other extension portion does not contact a cut out portion and even when the pair of extension portions both contact the cut out portions. When the integrated preform in which the coil is arranged in this manner is pressed and cured, the arrangement of the coil in the completed inductor is different in each inductor. Consequently, there is a problem in that variations occur in the characteristics of the inductors, for example, in the inductance value (L value) of the inductors.

SUMMARY

Accordingly, the present disclosure provides an inductor that includes an element body formed by installing a coil, which has a pair of extension portions that extend from different stages of a wound portion that is wound in a plurality of stages, between two preforms so that part of each extension portion extends to outside the preforms, the coil being arranged with high positional accuracy.

An inductor according to a preferred embodiment of the present disclosure includes an element body that is formed by pressing an integrated preform that has an integrated preform installed thereinside. The coil includes a wound portion, which is formed by winding a flat wire having a substantially rectangular cross section in a two-stage spiral shape, and extension portions that respectively extend from the two stages. The integrated preform is formed by bonding together a first preform and a second preform that include a magnetic powder and a resin. At least one out of the first preform and the second preform has a substantially housing-like shape that includes a substantially plate-shaped bottom portion, a wall portion that is provided around a periphery of the bottom portion, and cut out portions that are provided in the wall portion. The cut out portions are arranged in a pair in the integrated preform. When the coil is installed in the integrated preform, at least part of each extension portion extends to outside the integrated preform via a corresponding one of the cut out portions. A difference between a first distance from a reference surface, which is a bottom surface of the bottom portion of the first preform or the second preform, to a bottom surface of one cut out portion and a second distance from the reference surface to a bottom surface of the other cut out portion is substantially equal to an integer multiple of a length of the flat wire in a width direction of the flat wire.

The inductor according to the preferred embodiment of the present disclosure is an inductor that includes an element body formed by installing a coil, which has a pair of extension portions that extend from different stages of a wound portion that is wound in a plurality of stages, between two preforms so that part of each extension portion extends to outside the preforms, the coil being arranged with high positional accuracy.

Other features, elements, characteristics and advantages of the present disclosure will become more apparent from the following detailed description of preferred embodiments of the present disclosure with reference to the attached drawings.

DETAILED DESCRIPTION

Figure 1:
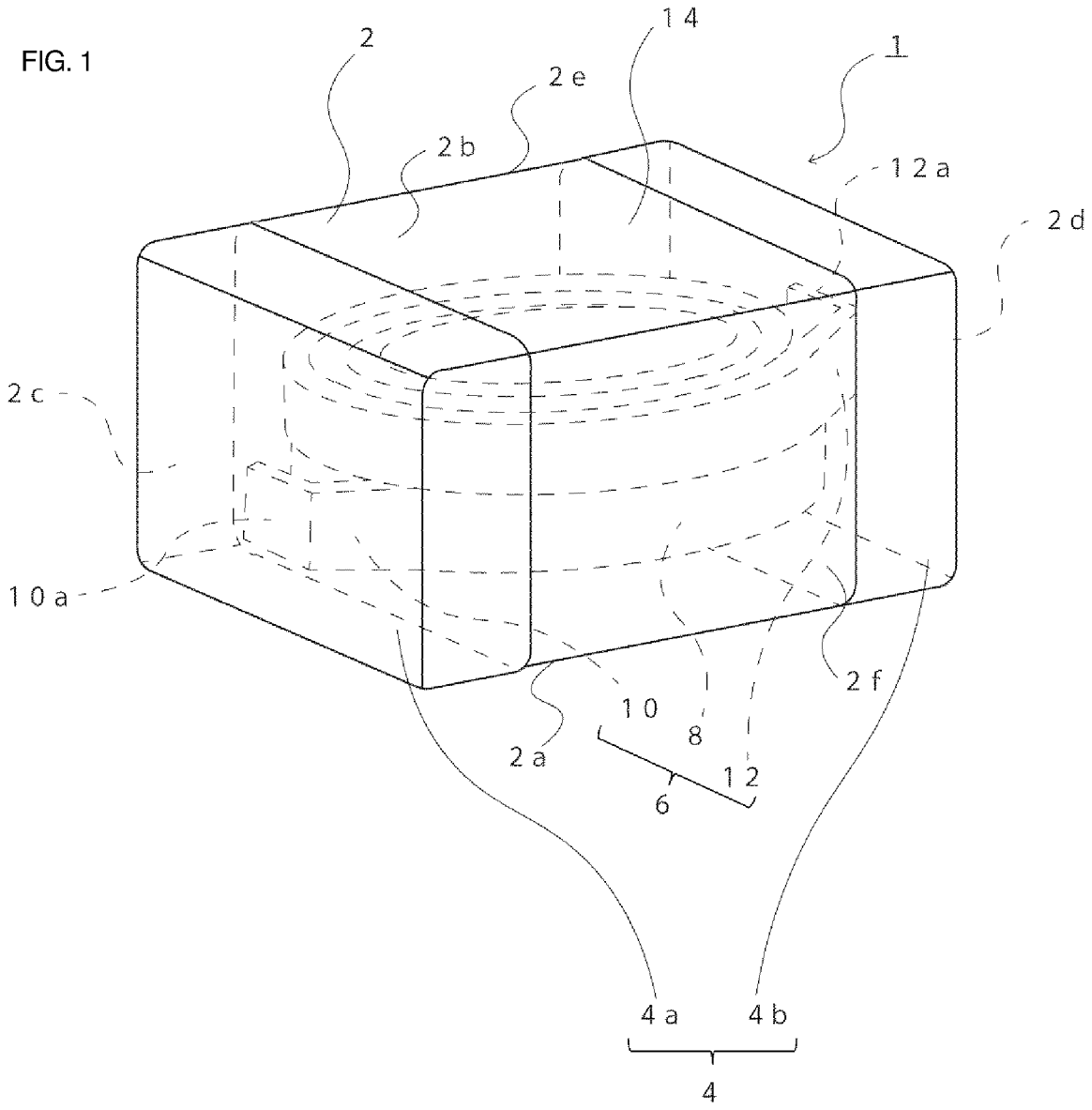
FIG. 1 is a perspective view illustrating an inductor formed of a first preform and a second preform according to an embodiment of the present disclosure.

Hereafter, embodiments and examples for carrying out the present disclosure will be described while referring to the drawings. The inductors described hereafter are merely for embodying the technical ideas of the present disclosure and the present disclosure is not limited by the following descriptions unless specifically stated. In the drawings, elements having identical functions to each other may be denoted by identical reference symbols. Taking explanation of important points or ease of understanding into account, the embodiments and examples are described in a separate manner for the sake of convenience, but parts of the configurations illustrated in the different embodiments and examples may be substituted for one another or combined with each other. In each of the following embodiments and examples, description of matters that are common to the previously described embodiments and examples is omitted and the description focuses on the points that are different. In particular, identical operational effects resulting from identical configurations are not repeatedly described in each embodiment and example. In addition, the sizes of the elements illustrated in the drawings, the positional relationships therebetween, and so forth may be exaggerated for the sake of clear explanations. In addition, in the following description, terms indicating specific directions or positions (for example, "up," "down," "right," "left," and other terms including these terms) are used as necessary. These terms are used in order to facilitate understanding of the disclosure while referring to the drawings, and the technical scope of the present disclosure is not limited by the meanings of these terms.

1. Inductor

First, an inductor 1 formed of a first preform and a second preform according to an embodiment of the present disclosure will be described while referring to FIG. 1. FIG. 1 is a perspective view illustrating the inductor 1 formed of the first preform and the second preform according to an embodiment of the present disclosure.

The inductor 1 includes an element body 2 and a pair of outer electrodes 4 formed on the surfaces of the element body 2. The element body 2 includes a coil 6 and a magnetic body 14. The coil 6 includes a wound portion 8 and a pair of extension portions 10 and 12 that extend from the wound portion 8. The wound portion 8 and part of each of the extension portions 10 and 12 are covered by the magnetic body 14. Exposed parts 10*a* and 12*a*, which are exposed from the magnetic body 14, of the extension portions 10 and 12 are covered by the outer electrodes 4 and electrically connected to the outer electrodes 4.

Element Body

The element body 2 includes the coil 6 and the magnetic body 14. The element body 2 has a substantially rectangular parallelepiped outer shape and has a bottom surface 2*a*, a top surface 2*b*, end surfaces 2*c* and 2*d*, which are side surfaces that extend in a lateral direction, and side surfaces 2*e* and 2*f*, which extend in a longitudinal direction. The dimensions of the element body 2 are, for example, a length in the longitudinal direction (length between end surface 2*c* and end surface 2*d*) of 1.6-3.2 mm, a length in the lateral direction (length between side surface 2*e* and side surface 21) of 0.8-2.5 mm, and a height (length between bottom surface 2*a* and top surface 2*b*) of 0.5-2.5 mm Coil The coil 6 includes the hollow wound portion 8 and the pair of extension portions 10 and 12 that extend from the wound portion 8. The wound portion 8 is formed by winding a conductive wire that has an insulating coating layer on the surface of a conductive wire and a fusion layer on the surface of the coating layer and has a rectangular cross section with wide surfaces that face each other (a so-called flat wire). The wound portion 8 is formed by winding the flat wire in a two-stage spiral shape with the two stages of the flat wire being connected to each other at the inner periphery of the wound portion 8. The extension portions 10 and 12 extend from the outer peripheries of the respective stages of the wound portion 8. The wound portion 8 and part of each of the extension portions 10 and 12 are covered by the magnetic body 14. The exposed parts 10*a* and 12*a*, which are exposed from the magnetic body 14, of the extension portions 10 and 12 are exposed at the end surfaces 2*c* and 2*d* of the element body and the coating layer and the fusion layer have been removed therefrom. The dimensions of the flat wire forming the coil 6 are, for example, a length in the width direction of 150-600 μm and a thickness of 20-200 μm.

Magnetic Body

The outer shape of the magnetic body 14 that covers the wound portion 8 and parts of the extension portions 10 and 12 is substantially the same as the outer shape of the element body 2 and is a substantially rectangular parallelepiped shape. The magnetic body 14 is formed by heating and pressing a first preform and a second preform, which are described later, inside a mold. The magnetic body 14 is formed by pressure molding a mixture consisting of a magnetic powder and a resin. The filling ratio of the magnetic powder in the mixture is, for example, 60 wt % or higher and preferably 80 wt % or higher. An iron-based metal magnetic powder such as Fe, Fe—Si—Cr, Fe—Ni—Al, Fe—Cr—Al, Fe—Si, Fe—Si—Al, Fe—Ni, or Fe—Ni—Mo, a metal magnetic powder having another composition basis, an amorphous metal magnetic powder or the like, a metal magnetic powder in which the surfaces of the powder particles are coated with an insulator such as glass, a surface-modified metal magnetic powder, or a nano-level fine metal magnetic powder is used as the magnetic powder. Furthermore, a thermosetting resin such as an epoxy resin, a polyimide resin, or a phenol resin, or a thermoplastic resin such as a polyethylene resin or a polyamide resin is used as the resin.

Outer Electrodes

The outer electrodes 4 consist of a pair of outer electrodes 4*a* and 4*b* that are arranged so as to be spaced apart from each other. In the inductor 1 illustrated in FIG. 1, one outer electrode 4*a* is arranged so as to cover the entire end surface 2*c* of the element body 2, the entire exposed part 10*a*, which is exposed from the magnetic body 14, of the extension portion 10, and part of each of the side surfaces 2*e* and 2*f*, part of the bottom surface 2*a*, and part of the top surface 2*b* of the element body 2, which are adjacent to the end surface 2*c*. The other outer electrode 4*b* covers the entire end surface 2*d* of the element body 2, the entire exposed part 12*a*, which is exposed from the magnetic body 14, of the extension portion 12, and part of each of the two side surfaces 2*e* and 2*f*, part of the bottom surface 2*a*, and part of the top surface 2*b* of the element body 2, which are adjacent to the end surface 2*d*. The outer electrodes 4*a* and 4*b* are formed by dipping the regions where these electrodes are to be arranged in a conductive paste.

2. Formation of Inductor

A method of manufacturing the inductor 1 includes:

(1) a first step of forming the coil 6;

(2) a second step of forming the element body 2 by arranging the coil 6 so as to be interposed between two preforms and pressing the two preforms sandwiching the coil 6 therebetween; and (3) a third step of forming outer electrodes 4 on surfaces of the element body 2.

An embodiment of the present disclosure is characterized by the shapes of the two preforms used in the second step. The two preforms used in an embodiment of the present disclosure are a substantially housing-shaped preform and a substantially plate-shaped preform or two substantially housing-shaped preforms. Hereafter, two preforms according to embodiment 1 will be described in detail.

Embodiment 1

Figure 2A:
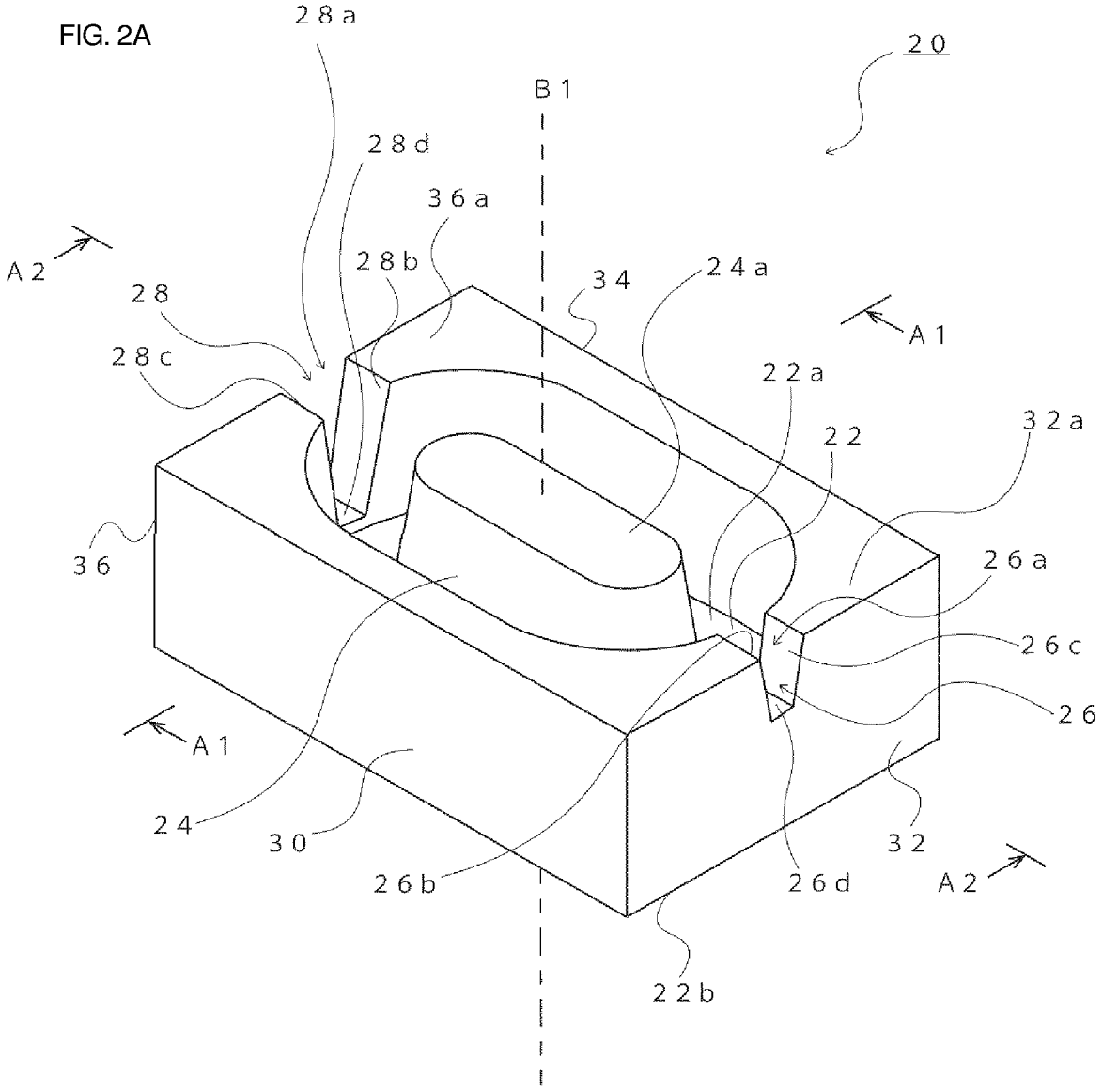
FIG. 2A is a perspective view illustrating a first preform according to embodiment 1 of the present disclosure.
Figure 2B:
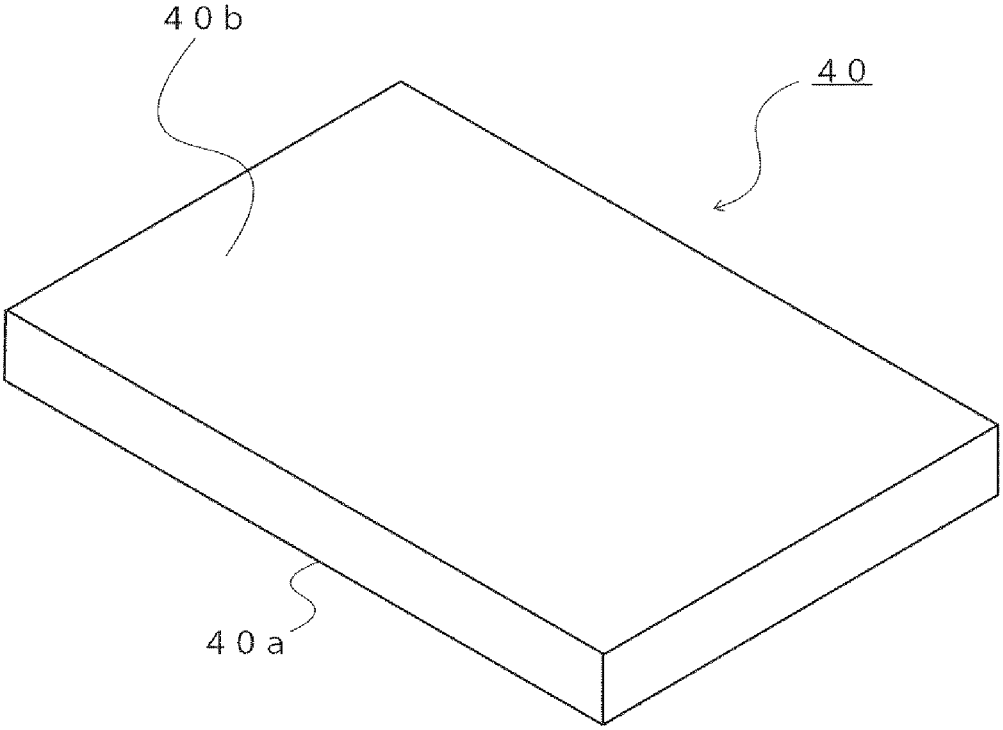
FIG. 2B is a perspective view illustrating a second preform according to embodiment 1 of the present disclosure.
Figure 3:
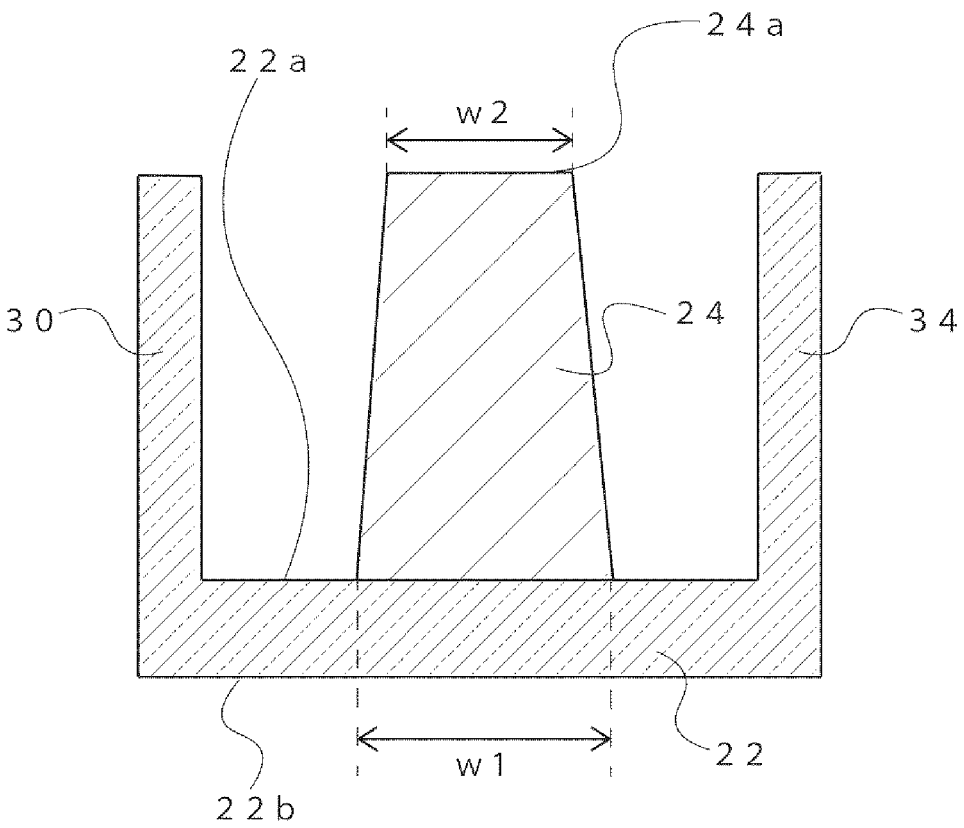
FIG. 3 is a sectional view taken along line A1-A1 in FIG. 2A.
Figure 4:
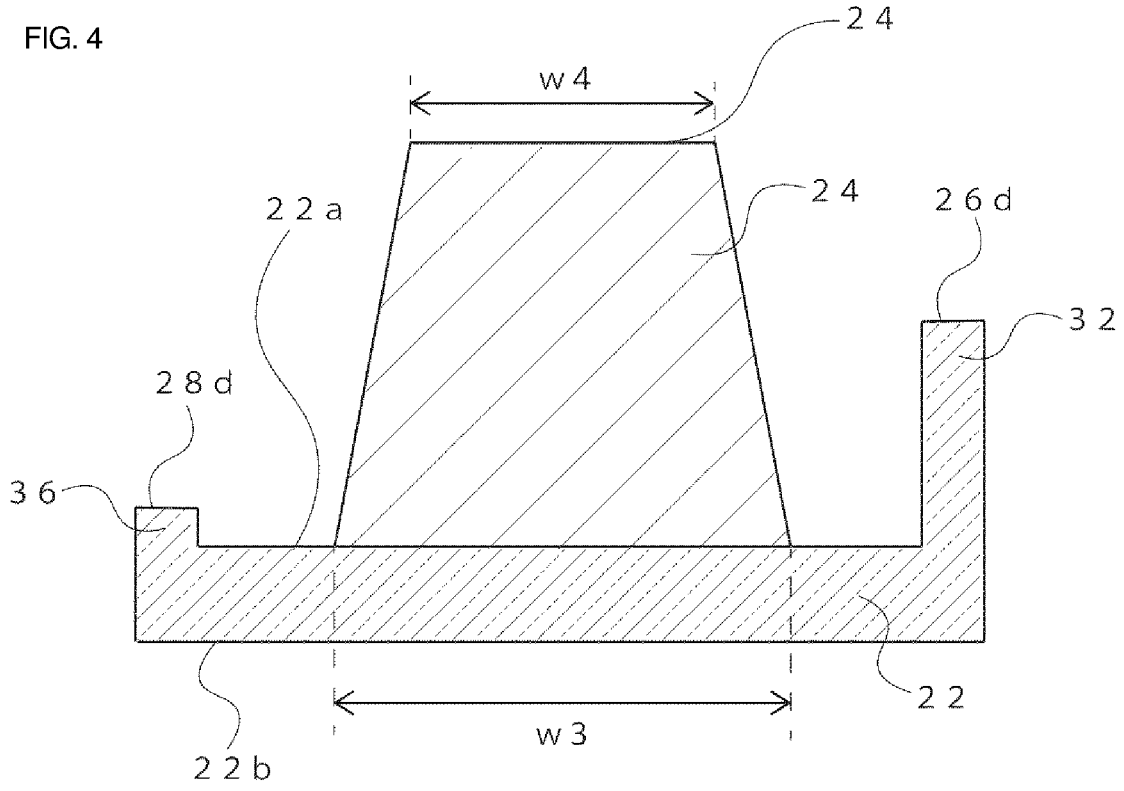
FIG. 4 is a sectional view taken along line A2-A2 in FIG. 2A.
Figure 5:
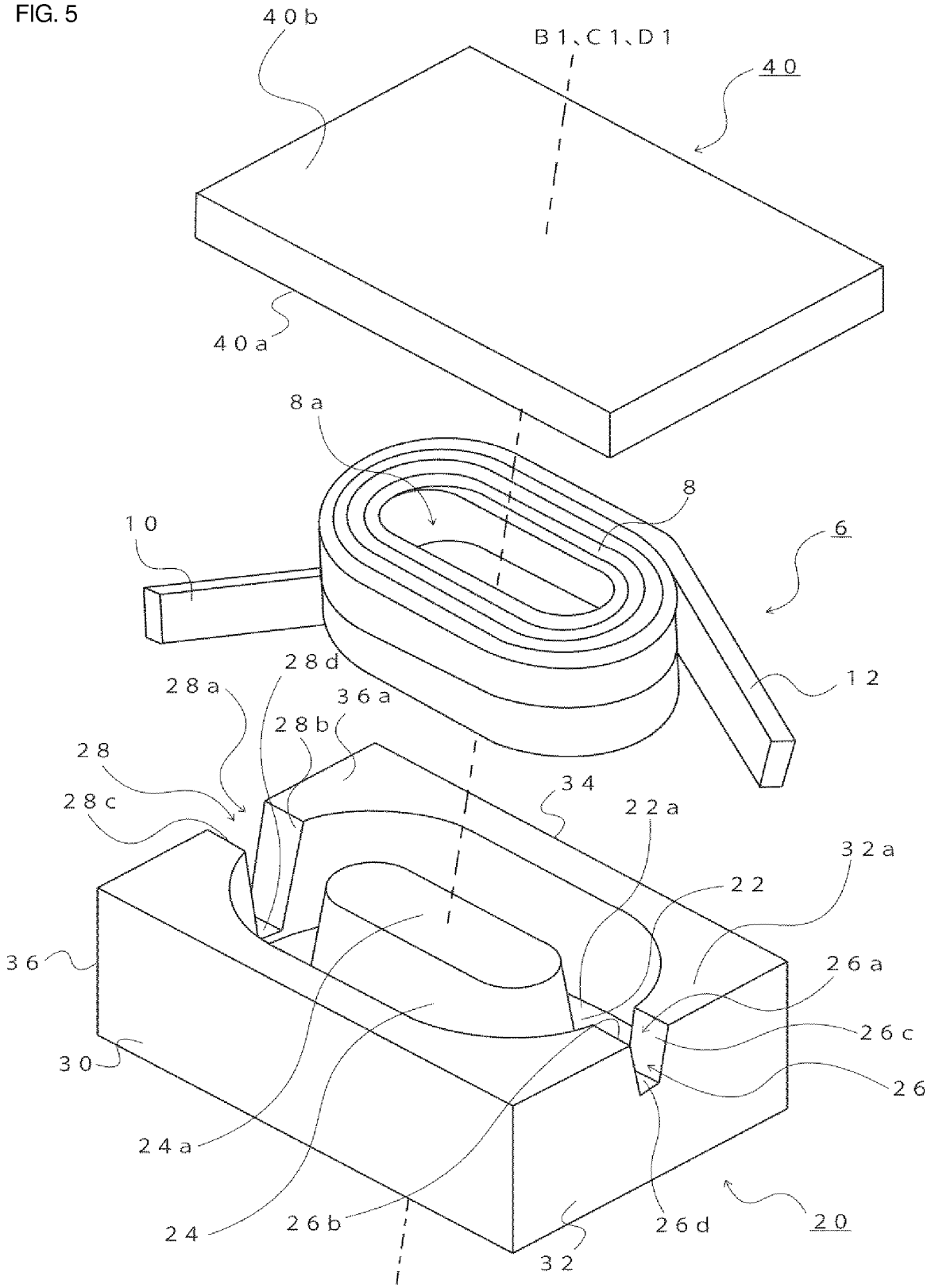
FIG. 5 is an assembly perspective view for when a coil is installed between the first preform and the second preform illustrated in FIGS. 2A and 2B.
Figure 6:
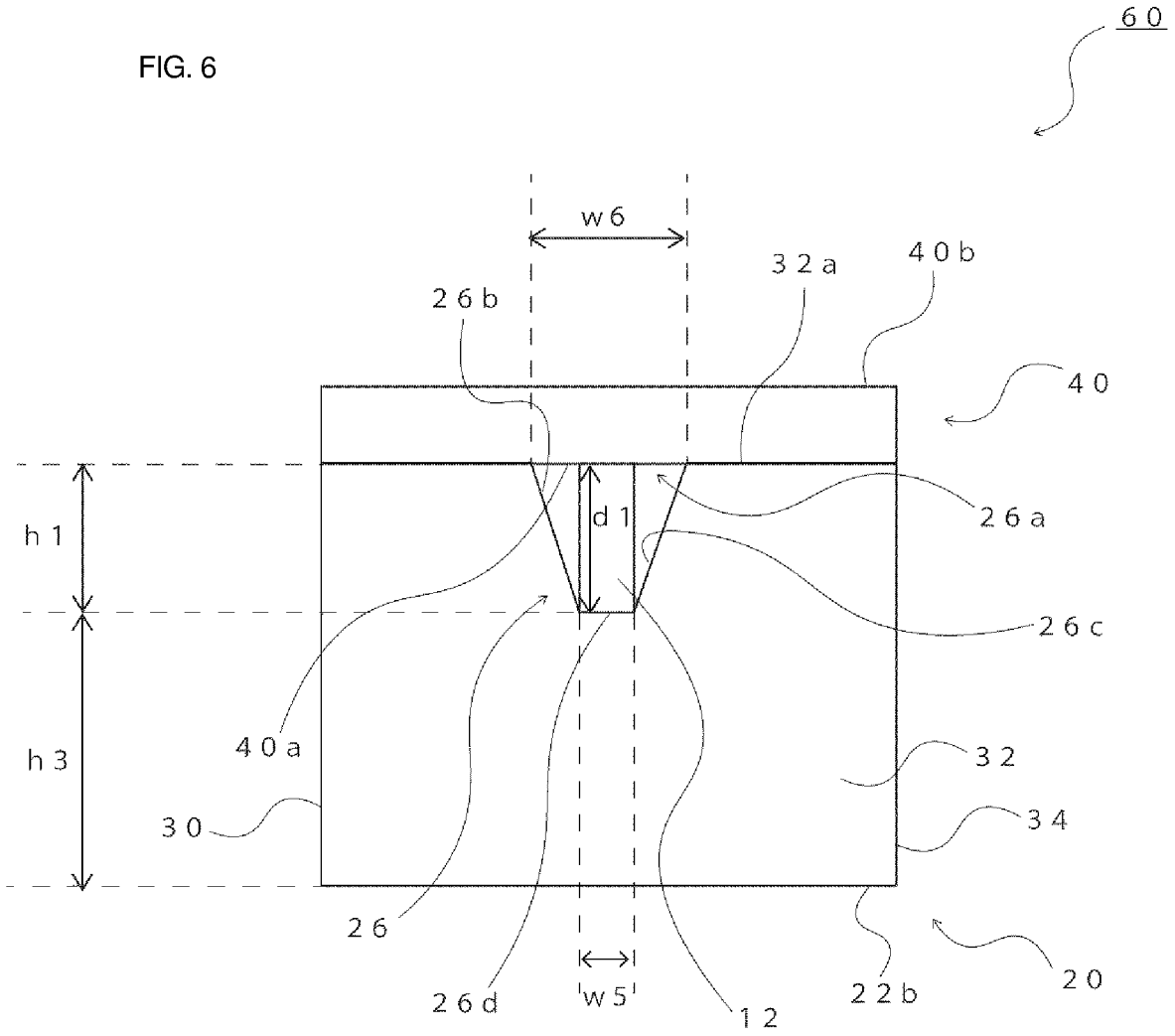
FIG. 6 is a side view in which the coil and an integrated preform formed through the assembly process depicted in FIG. 5 are seen from one side.
Figure 7:
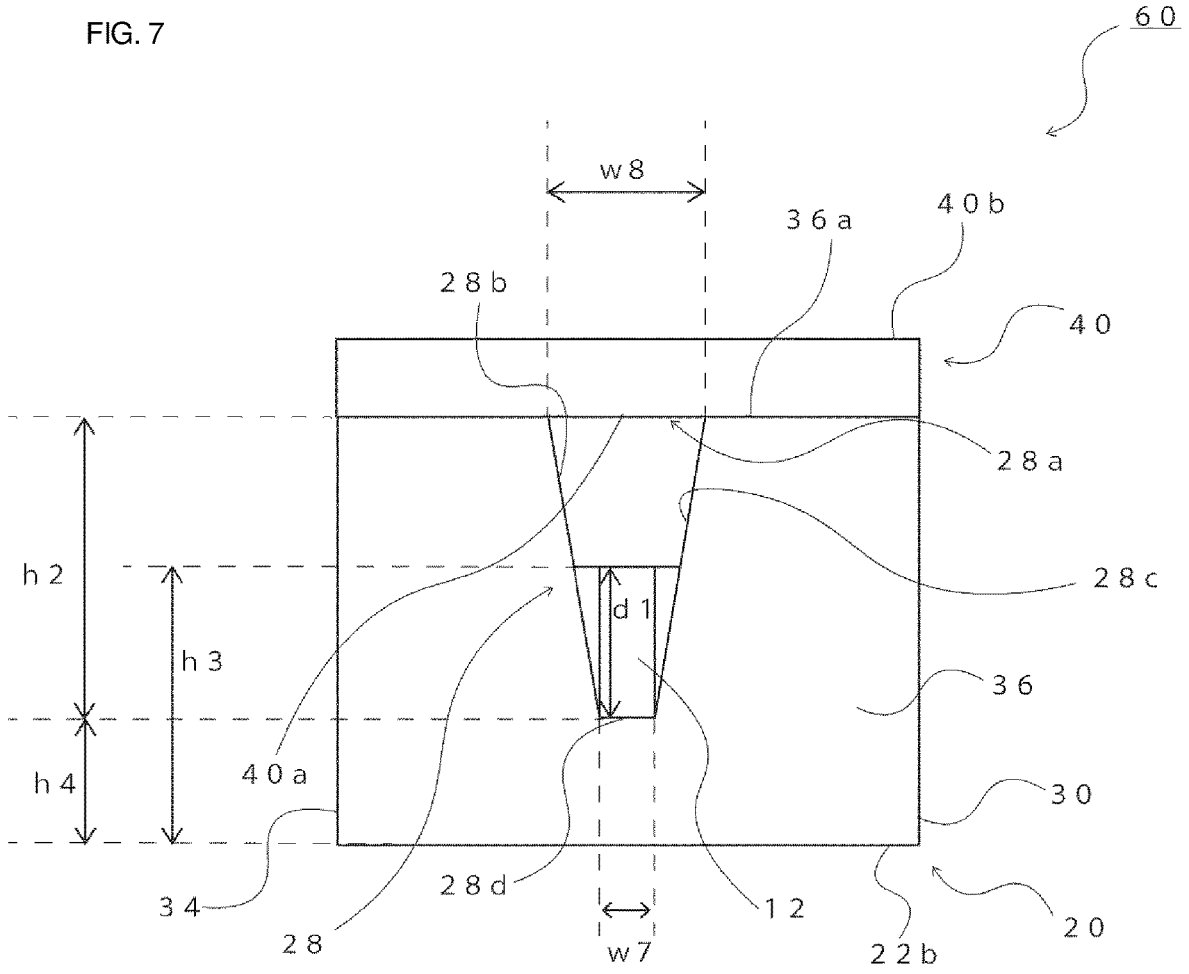
FIG. 7 is a side view in which the coil and the integrated preform formed through the assembly process depicted in FIG. 5 are seen from the other side.

A first preform 20 and a second preform 40 according to embodiment 1 of the present disclosure will be described while referring to FIGS. 2A to 7. The two preforms according to this embodiment consist of the substantially housing-shaped first preform 20 and the substantially plate-shaped second preform 40. FIG. 2A is a perspective view illustrating the first preform 20 according to embodiment 1 of the present disclosure and FIG. 2B is a perspective view illustrating the second preform 40 according to embodiment 1 of the present disclosure. FIG. 3 is a sectional view taken along line A1-A1 in FIG. 2A. FIG. 4 is a sectional view taken along line A2-A2 in FIG. 2A. FIG. 5 is an assembly perspective view for when the coil 6 is installed between the first preform 20 and the second preform 40 illustrated in FIGS. 2A and 2B. FIG. 6 is a side view in which the coil 6 and an integrated preform 60 formed through the assembly process depicted in FIG. 5 are seen from one side. FIG. 7 is a side view in which the coil 6 and the integrated preform 60 formed through the assembly process depicted in FIG. 5 are seen from the other side.

First Preform

As illustrated in FIG. 2A, the first preform 20 includes a substantially plate-shaped bottom portion 22, a substantially column-shaped winding axis portion 24 provided on a top surface 22*a* of the bottom portion 22, and four wall portions 30, 32, 34, and 36 that surround the winding axis portion 24 and are provided on the top surface 22*a* of the bottom portion 22. In one wall portion 32, a cut out portion (first cut out portion) 26, which has an opening 26*a*, is provided in a top surface 32*a* of the wall portion 32. In the wall portion 36 facing the wall portion 32, a cut out portion (second cut out portion) 28, which has an opening 28*a*, is provided in a top surface 36*a* of the wall portion 36. A cross section of the winding axis portion 24 in a direction substantially perpendicular to a center axis B1 of the winding axis portion 24 is a substantially ellipsoidal shape. As illustrated in FIG. 2A and in FIGS. 3 and 4, the winding axis portion 24 tapers in a direction away from the bottom portion 22. In other words, the tip of the winding axis portion 24 is narrower than the base of the winding axis portion 24 that is connected to the bottom portion 22. A length w1 of the base of the winding axis portion 24 in a short axis direction is for example 500 μm and a length w3 of the base of the winding axis portion 24 in a long axis direction is for example 800 μm. Furthermore, a length w2 of the tip of the winding axis portion 24 in the short axis direction is for example at least 40 μm shorter than the length w1 and a length w4 of the tip of the winding axis portion 24 in the long axis direction is also for example at least 40 μm shorter than the length w3.

As illustrated in FIG. 6, the first cut out portion 26 has a substantially trapezoidal shape in a side view. The first cut out portion 26 is formed of two facing side surfaces 26*b* and 26*c* and one bottom surface 26*d*. The bottom surface 26*d* is substantially parallel to a bottom surface 22*b* of the bottom portion 22. A width w5 of the bottom surface 26*d* of the first cut out portion 26 is smaller than a width w6 of the opening 26*a* of the first cut out portion 26. The width w5 of the bottom surface 26*d* substantially matches the thickness of the conductive wire that forms the coil 6 and is for example 20-200 μm and the width w6 of the opening 26*a* is for example at least 40 μm larger than the width w5. In the first preform 20 illustrated in the drawing, a depth h1 of the first cut out portion 26 substantially matches a length dl of the flat wire in the width direction of the flat wire. However, the depth h1 is not limited to this example and may instead be an arbitrarily chosen value so long as the value is greater than or equal to the length dl of the flat wire in the width direction and less than or equal to half the distance from the top surface 32*a* of the wall portion 32 to the top surface 22*a* of the bottom portion 22. Here, the width of the first cut out portion 26 corresponds to the length between the side surface 26*b* and the side surface 26*c*. The depth h1 of the first cut out portion 26 corresponds to the length between the top surface 32*a* of the wall portion 32 and the bottom surface 26*d* of the cut out portion 26.

As illustrated in FIG. 7, the second cut out portion 28 has a substantially trapezoidal shape in a side view. The second cut out portion 28 is formed of two facing side surfaces 28*b* and 28*c* and one bottom surface 28*d*. The bottom surface 28*d* is substantially parallel to the bottom surface 22*b* of the bottom portion 22. A width w7 of the bottom surface 28*d* of the second cut out portion 28 is smaller than a width w8 of the opening 28*a* of the second cut out portion 28. The width w7 of the bottom surface 28*d* substantially matches the thickness of the conductive wire that forms the coil 6 and is for example 20-200 μm and the width w8 of the opening 28*a* is for example at least 40 μm larger than the width w7. The second cut out portion 28 is formed so that a depth h2 thereof is larger than the depth h1 of the first cut out portion 26 by the width-direction length dl of the flat wire. Here, the width of the second cut out portion 28 corresponds to the length between the side surface 28*b* and the side surface 28*c*. The depth h2 of the second cut out portion 28 corresponds to the length between the top surface 36*a* of the wall portion 36 and the bottom surface 28*d* of the cut out portion 28.

The first preform 20 is for example formed by molding a composite material including a resin and a magnetic powder in a mold.

Second Preform

As illustrated in FIG. 2B, the second preform 40 is a substantially plate-shaped member having two substantially rectangular-shaped main surfaces 40*a* and 40*b*. The second preform 40 is also for example formed by molding a composite material including a resin and a magnetic powder in a mold.

The first preform 20 and the second preform 40 may be formed using the same magnetic powder or may be formed using magnetic powders having different average particle diameters, compositions, densities, and so on. For example, the average particle diameter of the magnetic powder used to form the first preform 20 is 10-50 μm and the average particle diameter of the magnetic powder used to form the second preform 40 is 10-50 μm.

As illustrated in FIG. 5, the top surface 22*a* of the bottom portion 22 of the first preform 20 and one main surface 40*a* (or 40*b*) of the second preform 40 are made to face each other and the coil 6 is installed between the first preform 20 and the second preform 40. The first preform 20 and the second preform 40 are bonded to each other with the coil 6 interposed therebetween and form the integrated preform 60. As illustrated in FIG. 7, in the integrated preform 60, the difference between a first distance h3 from the bottom surface (reference surface) 22*b* of the bottom portion 22 to the bottom surface 26*d* of the first cut out portion 26 and a second distance h4 from the reference surface 22*b* to the bottom surface 28*d* of the second cut out portion 28 is substantially equal to the length dl of the flat wire in the width direction of the flat wire. In other words, in the integrated preform 60, the difference between the first distance h3 and the second distance h4 is substantially equal to the length dl of the flat wire in the width direction of the flat wire.

The inductor 1 is formed using the thus-configured first preform 20 and second preform 40. Hereafter, the above first to third steps will be described using the first preform 20 and the second preform 40.

First Step: Formation of Coil

The coil 6 is formed using a conductive wire that includes a conductive wire, an insulating coating layer formed on the surface of the wire, and a fusion layer formed on the surface of the coating layer, and the wire has wide surfaces that face each other (a so-called flat wire). The wound portion 8 is formed by winding the conductive wire in two stages in a vertical direction (a so-called alpha winding) with the two ends of the conductive wire being located at the outer periphery of the wound portion 8 and the parts of the conductive wire located in the two stages being connected to each other at the inner periphery of the wound portion 8. The extension portions 10 and 12 extend from the outer periphery of the wound portion 8.

Second Step: Step of Forming Element Body by Arranging Coil so as to be Interposed between First Preform and Second Preform and Performing Pressing This step includes a step of arranging the coil 6 between the first preform 20 and the second preform 40 formed in a mold, a step of performing molding and curing, and a step of removing a coating layer.

Step of Arranging Coil in First Preform and Second Preform

The coil 6 is arranged between the first preform 20 and the second preform 40 so that the winding axis portion 24 of the first preform 20 is arranged inside a hollow region 8*a* of the wound portion 8. At this time, the coil 6 is arranged so that the extension portions 10 and 12 of the coil 6 extend to outside the first preform 20 from the first and second cut out portions 26 and 28. Specifically, the coil 6 is arranged so that the parts of the extension portions 10 and 12 that are to be arranged in the first and second cut out portions 26 and 28 are positioned within the widths w6 and w8 of the openings 26*a* and 28*a*. The parts of the extension portions 10 and 12 that protrude to outside the first preform 20 and the second preform 40 are bent along the side surfaces of the element body 2.

Step of Molding and Curing

The first preform 20 and the second preform 40 between which the coil 6 has been installed are accommodated in the cavity of the mold. The inside of the mold is heated to a temperature greater than or equal to the softening temperature of the resin used as the material of the first preform 20 and the second preform 40 (for example, 60-150° C.). The resin is molded and cured by applying pressure at around 100-500 kg/cm$^2$ in the heated state and then further raising the temperature to be greater than or equal to the curing temperature of the resin (for example, 100-120° C.). Thus, the element body 2 is formed. The curing may be performed after the molding has been performed.

Step of Removing Coating Layer

The coating layer and the fusion layer of the conductive wire are removed from the parts of the extension portions 10 and 12 that protrude to outside the first preform 20 and the second preform 40. The removal is performed using a physical method such as a laser processing, plasma processing, grinding, and so on.

Third Step: Step of Forming Outer Electrodes

The outer electrodes 4 are formed by dipping the end surfaces 2*c* and 2*d* of the element body 2 in a conductive paste. The outer electrodes 4 may be formed by forming a second layer formed of nickel on a first layer formed of a conductive paste, and forming a third layer formed of tin on the second layer.

Effect

In the integrated preform 60, the difference between the first distance h3 and the second distance h4 is substantially equal to the length dl of the flat wire in the width direction of the flat wire. As a result, in the integrated preform 60, one extension portion 12 of the coil 6 is supported by the bottom surface 26*d* of the first cut out portion 26 and the other extension portion 10 is supported by the bottom surface 28*d* of the second cut out portion 28. In addition, in the integrated preform 60, a winding center axis C1 of the coil 6 substantially coincides with a vertical-direction center axis D1 of the integrated preform 60. Therefore, the accuracy with which the coil 6 is arranged in the integrated preform 60 can be increased by using the thus-configured first preform 20 and second preform 40, and variations in the characteristics of the completed inductor 1 can be effectively suppressed.

In addition, in the first and second cut out portions 26 and 28, the widths w6 and w8 of openings 26*a* and 28*a* are larger than the widths w5 and w7 of the bottom surfaces 26*d* and 28*d*. Thus, when arranging the coil 6 inside the integrated preform 60, it is sufficient to simply arrange the coil 6 so that the parts of the extension portions 10 and 12 that are to be arranged in the first and second cut out portions 26 and 28 are positioned within the widths w6 and w8 of the openings 26*a* and 28*a* and thus arranging of the coil 6 is facilitated. In addition, the side surfaces 26*b* and 26*c* of the cut out portion 26 and the side surfaces 28*b* and 28*c* of the cut out portion 28 are inclined surfaces. Consequently, the extension portions 10 and 12, which are arranged so as to fit within the widths w6 and w8 of the openings 26*a* and 28*a*, move in a sliding manner along the side surfaces 26*b*, 26*c*, 28*b*, and 28*c* and can readily reach the bottom surfaces 26*d* and 28*d* of the cut out portions 26 and 28.

Furthermore, the winding axis portion 24 of the first preform 20 tapers from the base to the tip thereof. As a result, when arranging the coil 6 in the first preform 20, it is sufficient to simply arrange the coil 6 so that a tip part 24*a* of the winding axis portion 24 is contained inside the hollow region 8*a* of the wound portion 8 and therefore arranging of the coil 6 is facilitated and the accuracy with which the coil 6 is positioned is also increased.

Embodiment 2

Figure 8A:
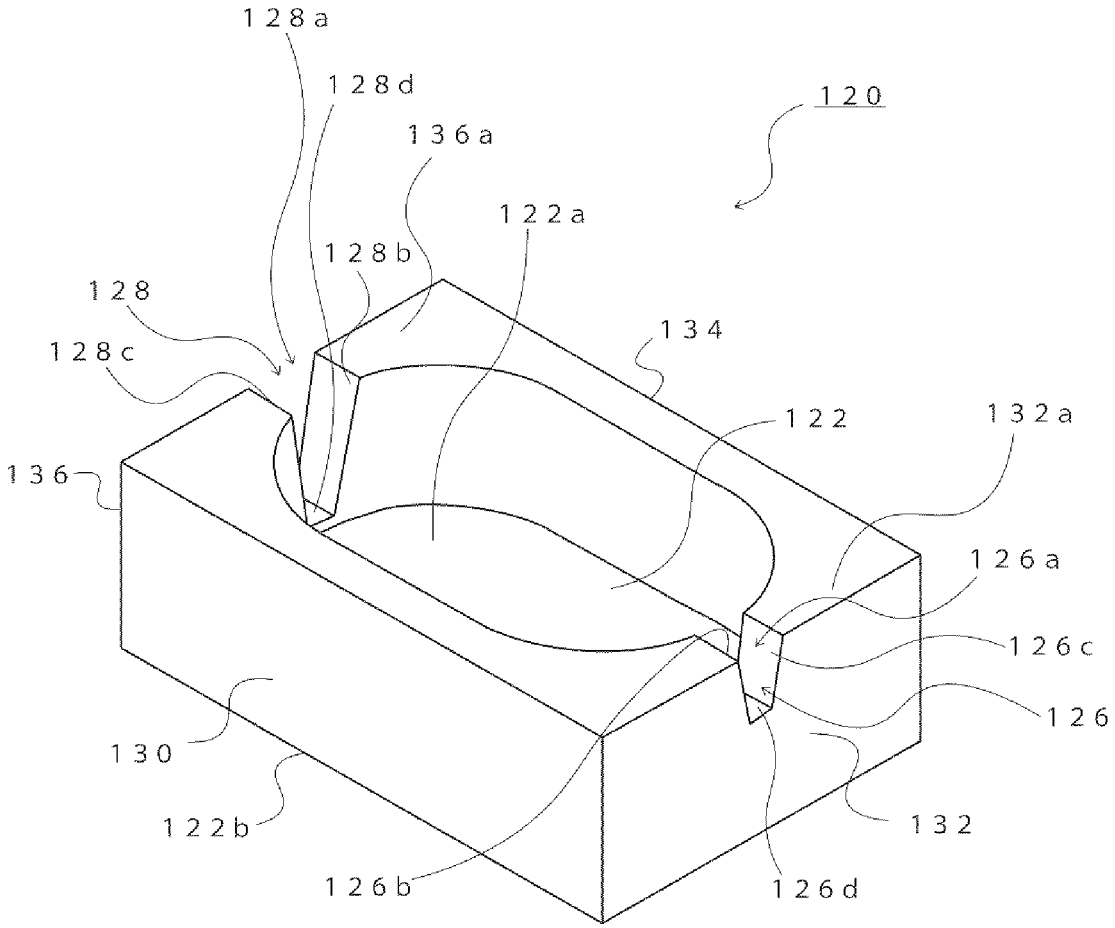
FIG. 8A is a perspective view illustrating a first preform according to embodiment 2 of the present disclosure.
Figure 8B:
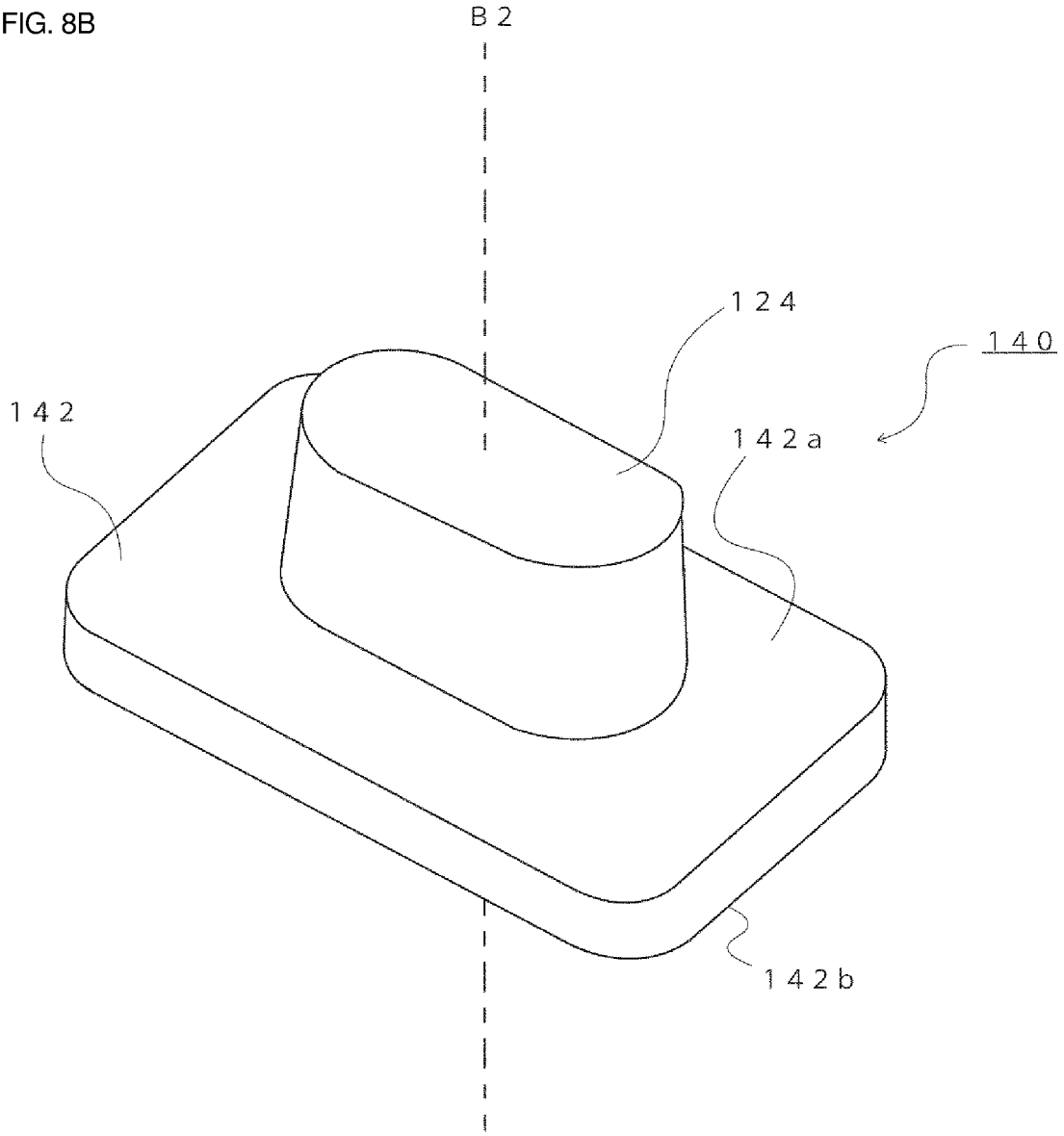
FIG. 8B is a perspective view illustrating a second preform according to embodiment 2 of the present disclosure.
Figure 9:
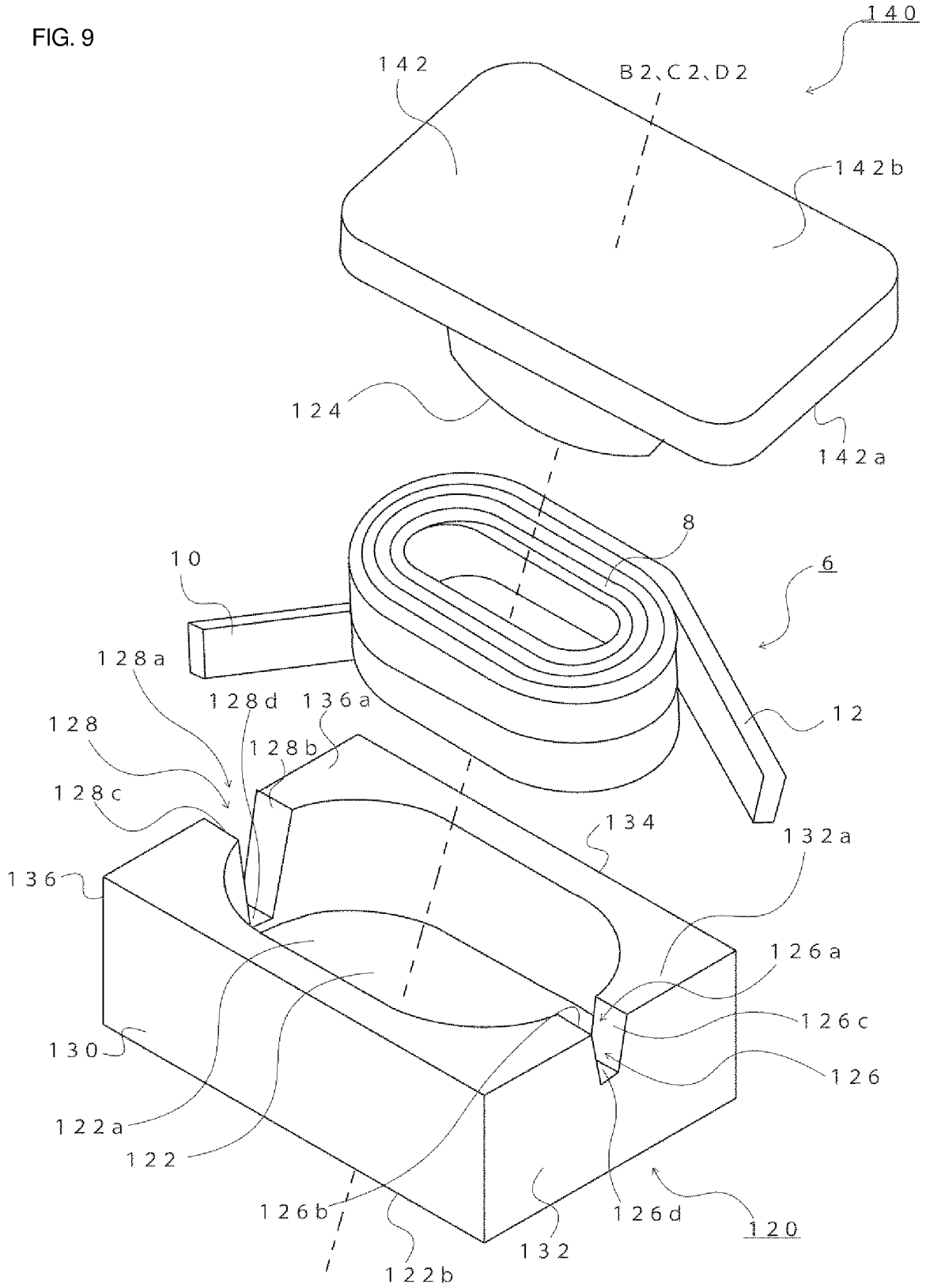
FIG. 9 is an assembly perspective view for when a coil is installed between the first preform and the second preform illustrated in FIGS. 8A and 8B.
Figure 10:
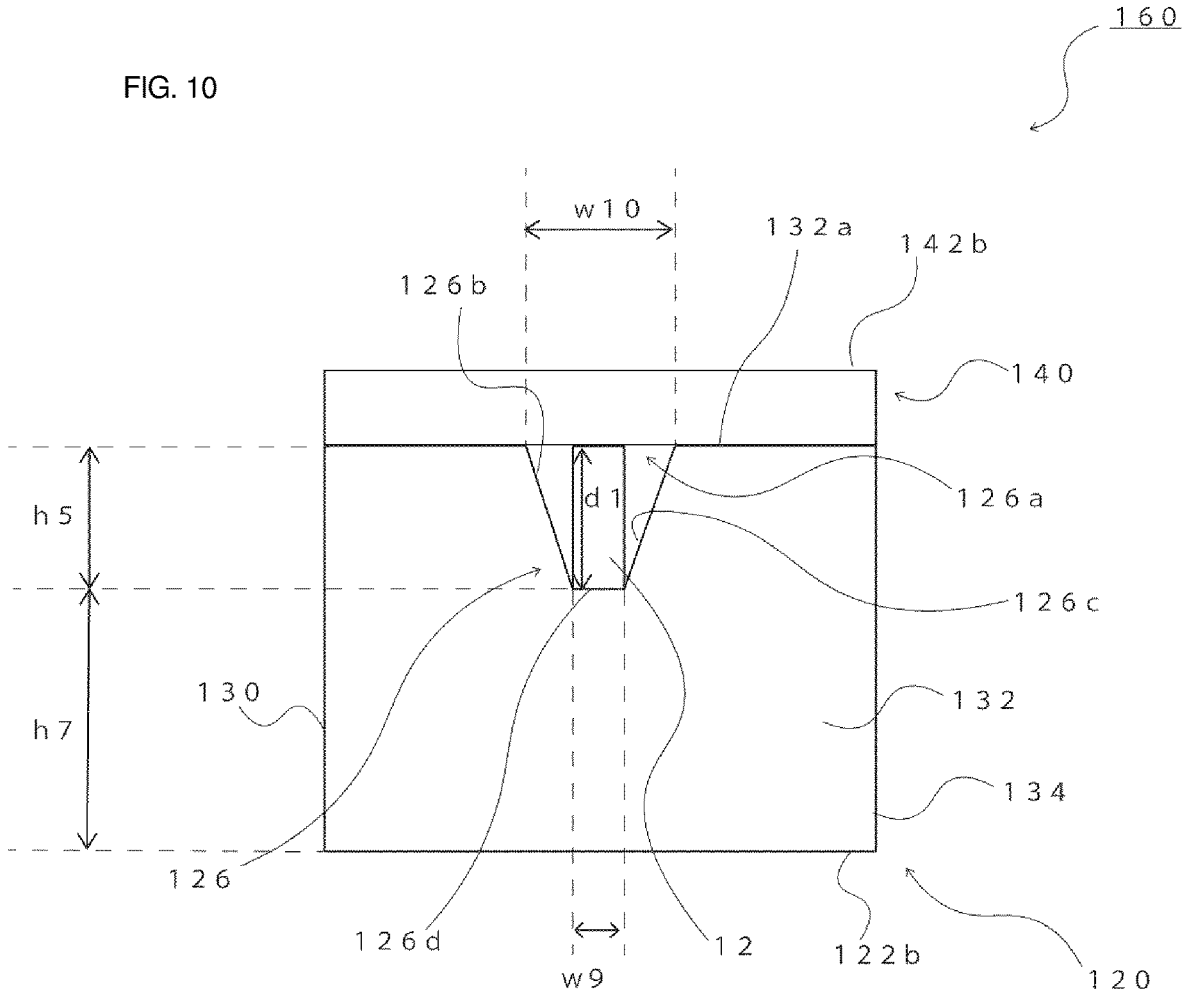
FIG. 10 is a side view in which the coil and an integrated preform formed through the assembly process depicted in FIG. 9 are seen from one side.
Figure 11:
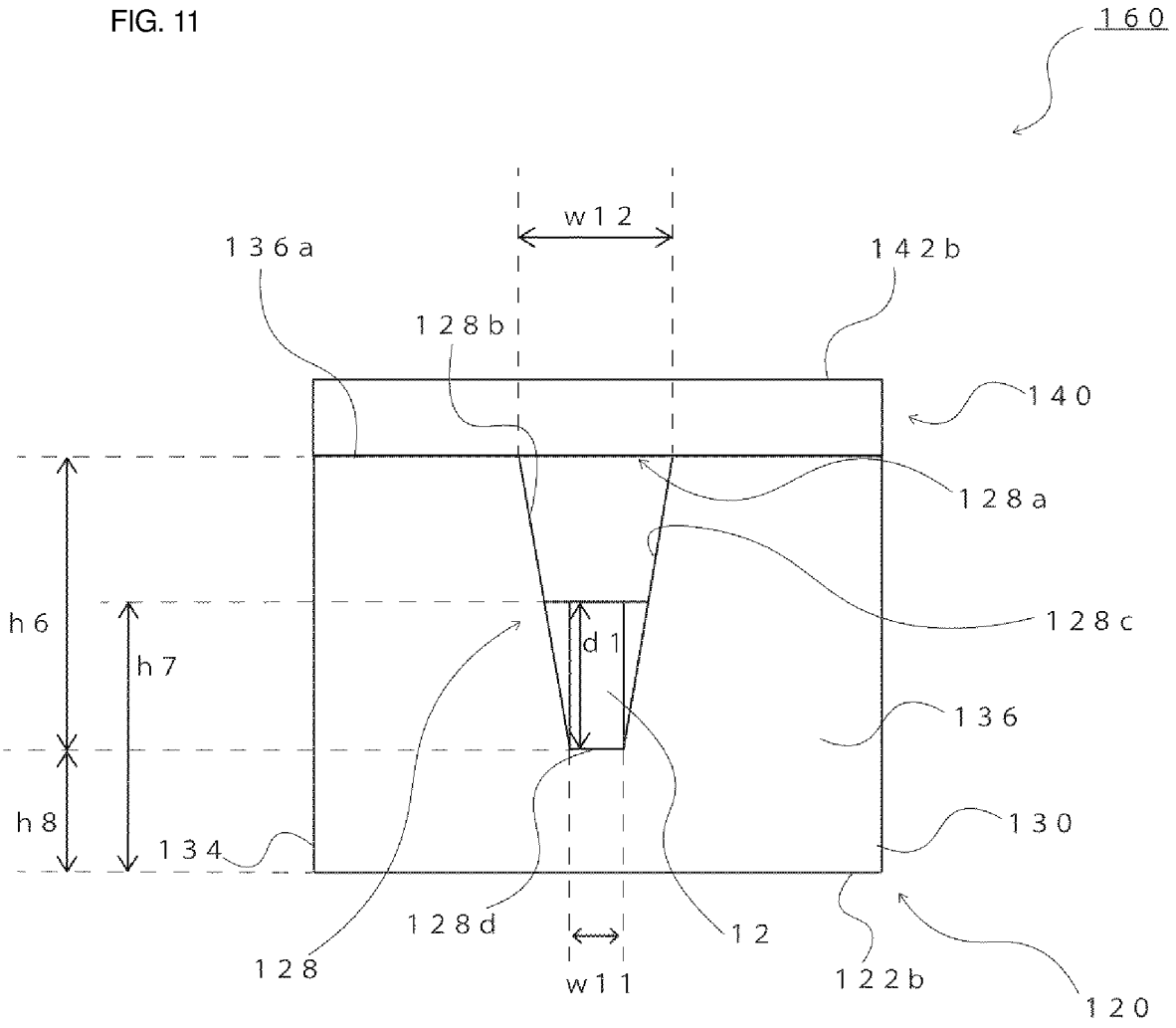
FIG. 11 is a side view in which the coil and the integrated preform formed through the assembly process depicted in FIG. 9 are seen from the other side.

Next, a first preform 120 and a second preform 140 according to embodiment 2 will be described while referring to FIGS. 8A to 11. The first preform 120 according to this embodiment is substantially housing shaped and the second preform 140 is substantially plate shaped. FIG. 8A is a perspective view illustrating the first preform 120 according to embodiment 2 of the present disclosure. FIG. 8B is a perspective view illustrating the second preform 140 according to embodiment 2 of the present disclosure. FIG. 9 is an assembly perspective view for when the coil 6 is installed between the first preform 120 and the second preform 140 illustrated in FIGS. 8A and 8B. FIG. 10 is a side view in which the coil 6 and an integrated preform 160 formed through the assembly process depicted in FIG. 9 are seen from one side. FIG. 11 is a side view in which the coil 6 and the integrated preform 160 formed through the assembly process depicted in FIG. 9 are seen from the other side.

Embodiment 2 differs from embodiment 1 in that the first preform is provided with the wound portion in embodiment 1 described above, whereas the second preform is provided with the wound portion in embodiment 2.

First Preform

As illustrated in FIG. 8A, the first preform 120 includes a substantially plate-shaped bottom portion 122 and four wall portions 130, 132, 134, and 136 that are provided on a top surface 122*a* of the bottom portion 122. In one wall portion 132, a cut out portion (first cut out portion) 126, which has an opening 126*a*, is provided in a top surface 132*a* of the wall portion 132. In the wall portion 136 facing the wall portion 132, a cut out portion (second cut out portion) 128, which has an opening 128*a*, is provided in a top surface 136*a* of the wall portion 136.

As illustrated in FIG. 10, the first cut out portion 126 has a substantially trapezoidal shape in a side view. The first cut out portion 126 is formed of two facing side surfaces 126*b* and 126*c* and one bottom surface 126*d*. The bottom surface 126*d* is substantially parallel to a bottom surface 122*b* of the bottom portion 122. A width w9 of the bottom surface 126*d* of the first cut out portion 126 is smaller than a width w10 of the opening 126*a* of the first cut out portion 126. The width w9 of the bottom surface 126*d* substantially matches the thickness of the conductive wire that forms the coil 6 and is for example 20-200 μm and the width w10 of the opening 126*a* is for example at least 40 μm larger than the width w9. In the first preform 120 illustrated in the drawing, a depth h5 of the first cut out portion 126 substantially matches a length dl of the flat wire in the width direction of the flat wire. However, the depth h5 is not limited to this example and may instead be an arbitrarily chosen value so long as the value is greater than or equal to the length dl of the flat wire in the width direction and less than or equal to half the distance from the top surface 132*a* of the wall portion 132 to the top surface 122*a* of the bottom portion 122. Here, the width of the first cut out portion 126 corresponds to the length between the side surface 126*b* and the side surface 126*c*. The depth h5 of the first cut out portion 126 corresponds to the length between the top surface 132*a* of the wall portion 132 and the bottom surface 126*d* of the cut out portion 126.

As illustrated in FIG. 11, the second cut out portion 128 has a substantially trapezoidal shape in a side view. The second cut out portion 128 is formed of two facing side surfaces 128*b* and 128*c* and one bottom surface 128*d*. The bottom surface 128*d* is substantially parallel to a bottom surface 122*b* of the bottom portion 122. A width w11 of the bottom surface 128*d* of the second cut out portion 128 is smaller than a width w12 of the opening 128*a* of the second cut out portion 128. The width w11 of the bottom surface 128*d* substantially matches the thickness of the conductive wire that forms the coil 6 and is for example 20-200 μm and the width w12 of the opening 128*a* is for example at least 40 μm larger than the width w11. The second cut out portion 128 is formed so that a depth h6 thereof is larger than the depth h5 of the first cut out portion 126 by the width-direction length dl of the flat wire. Here, the width of the second cut out portion 128 corresponds to the length between the side surface 128*b* and the side surface 128*c*. The depth h6 of the second cut out portion 128 corresponds to the length between the top surface 136*a* of the wall portion 136 and the bottom surface 128*d* of the cut out portion 128.

Second Preform

As illustrated in FIG. 8B, the second preform 140 includes a substantially plate-shaped substrate 142 having two substantially rectangular main surfaces 142*a* and 142*b* and a substantially column-shaped winding axis portion 124 that is provided on the one main surface 142*a*.

A cross section of the winding axis portion 124 in a direction substantially perpendicular to a center axis B2 is a substantially ellipsoidal shape. The winding axis portion 124 tapers in a direction away from the substrate 142. In other words, the tip of the winding axis portion 124 is narrower than the base of the winding axis portion 124 that is connected to the substrate 142. A length of the base of the winding axis portion 124 in a short axis direction is for example 500 μm and a length of the base of the winding axis portion 124 in a long axis direction is for example 800 μm. In addition, a length of the tip of the winding axis portion 124 in the short axis direction is for example at least 40 μm smaller than the length of the base of the winding axis portion 124 in the short axis direction, and the length of the tip of the winding axis portion 124 in the long axis direction is for example also at least 40 μm smaller than the length of the base of the winding axis portion 124 in the long axis direction.

As illustrated in FIG. 9, the top surface 122*a* of the bottom portion 122 of the first preform 120 and the winding axis portion 124 of the second preform 140 are made to face each other and the coil 6 is installed between the first preform 120 and the second preform 140. The coil 6 is installed between the first preform 120 and the second preform 140. The first preform 120 and the second preform 140 are bonded to each other with the coil 6 interposed therebetween and form the integrated preform 160. As illustrated in FIG. 11, in the integrated preform 160, the difference between a first distance h7 from the bottom surface (reference surface) 122*b* of the bottom portion 122 to the bottom surface 126*d* of the first cut out portion 126 and a second distance h8 from the reference surface 122*b* to the bottom surface 128*d* of the second cut out portion 128 is substantially equal to the length dl of the flat wire in the width direction of the flat wire. In other words, in the integrated preform 160, the difference between the first distance h7 and the second distance h8 is substantially equal to the length dl of the flat wire in the width direction of the flat wire.

Effect

In the integrated preform 160, the difference between the first distance h7 and the second distance h8 is substantially equal to the length dl of the flat wire in the width direction of the flat wire. As a result, in the integrated preform 160, one extension portion 12 of the coil 6 is supported by the bottom surface 126*d* of the first cut out portion 126 and the other extension portion 10 is supported by the bottom surface 128*d* of the second cut out portion 128. In addition, in the integrated preform 160, a winding center axis C2 of the coil 6 substantially coincides with a vertical-direction center axis D2 of the integrated preform 160. Therefore, the accuracy with which the coil 6 is arranged in the integrated preform 160 can be increased by using the thus-configured first preform 120 and second preform 140, and variations in the characteristics of the completed inductor 1 can be effectively suppressed.

Furthermore, the first preform 120 is not provided with the winding axis portion 124. Therefore, when installing the coil 6 in the integrated preform 160, the arrangement of the coil 6 with respect to the first preform 120 can be adjusted by simply adjusting the positions of the extension portions 10 and 12 with respect to the cut out portions 126 and 128 and thus arranging of the coil 6 is facilitated.

Embodiment 3

Figure 12:
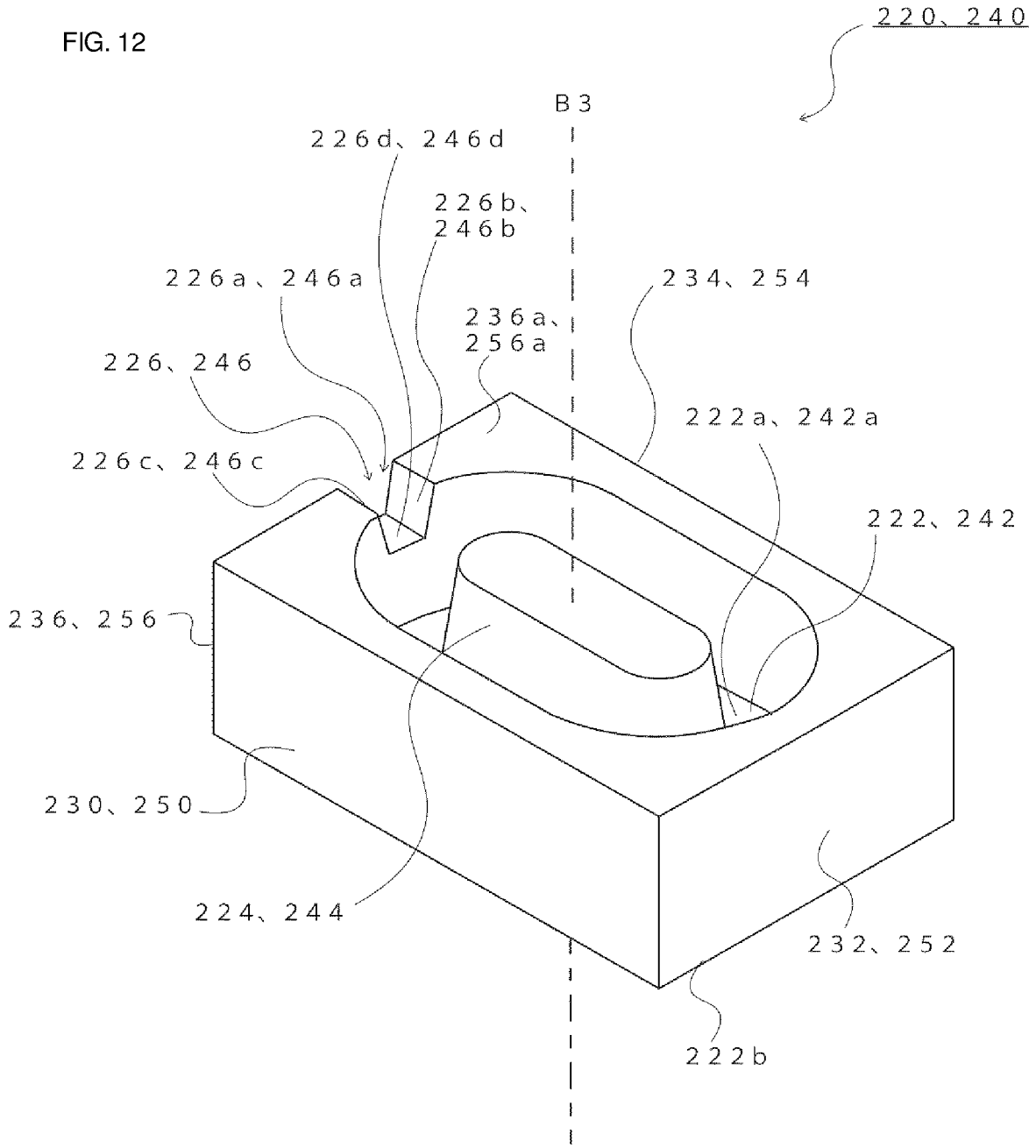
FIG. 12 is a perspective view illustrating a first preform and a second preform according to embodiment 3 of the present disclosure.
Figure 13:
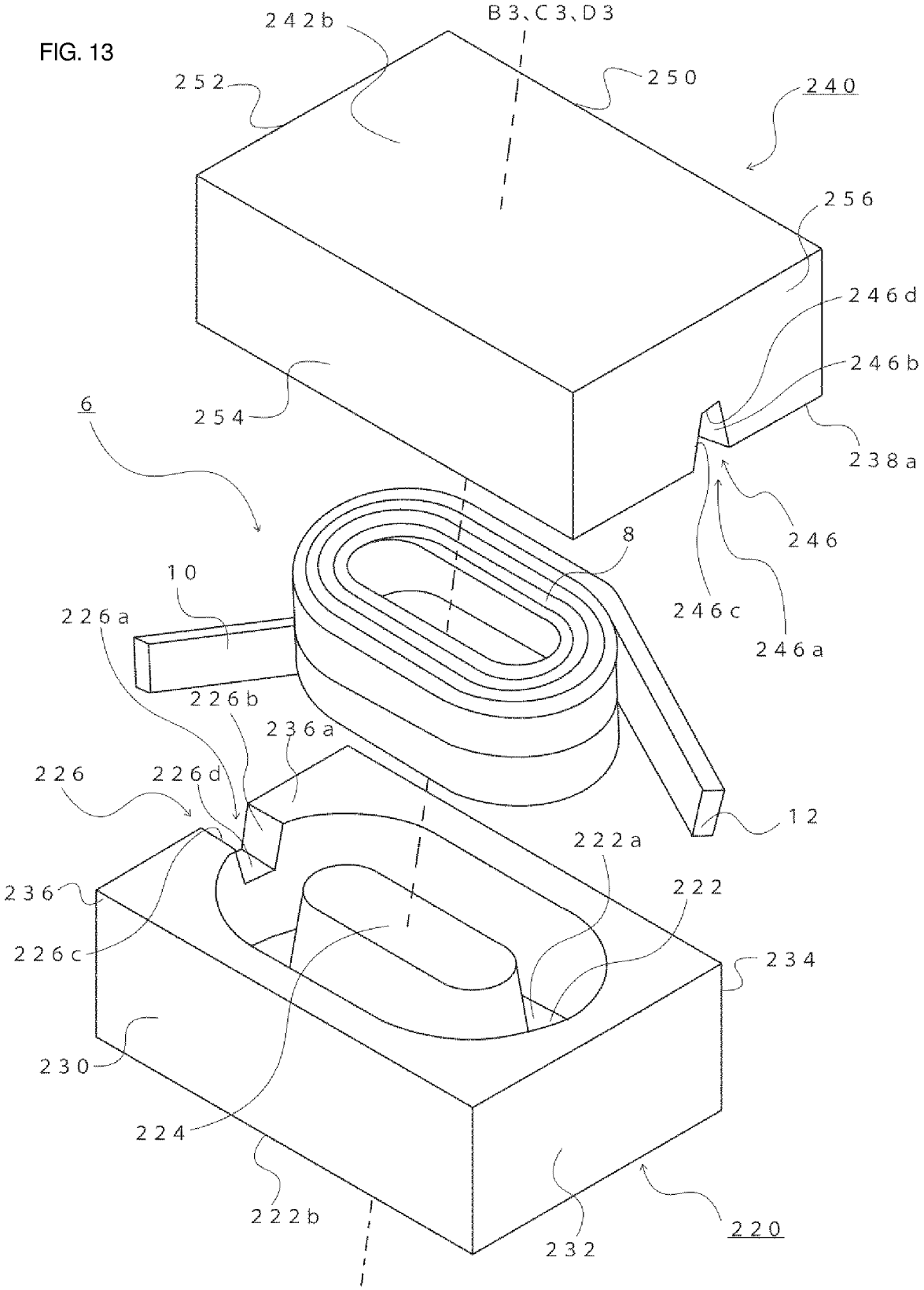
FIG. 13 is an assembly perspective view for when a coil is installed between the first preform and the second preform illustrated in FIG. 12.
Figure 14:
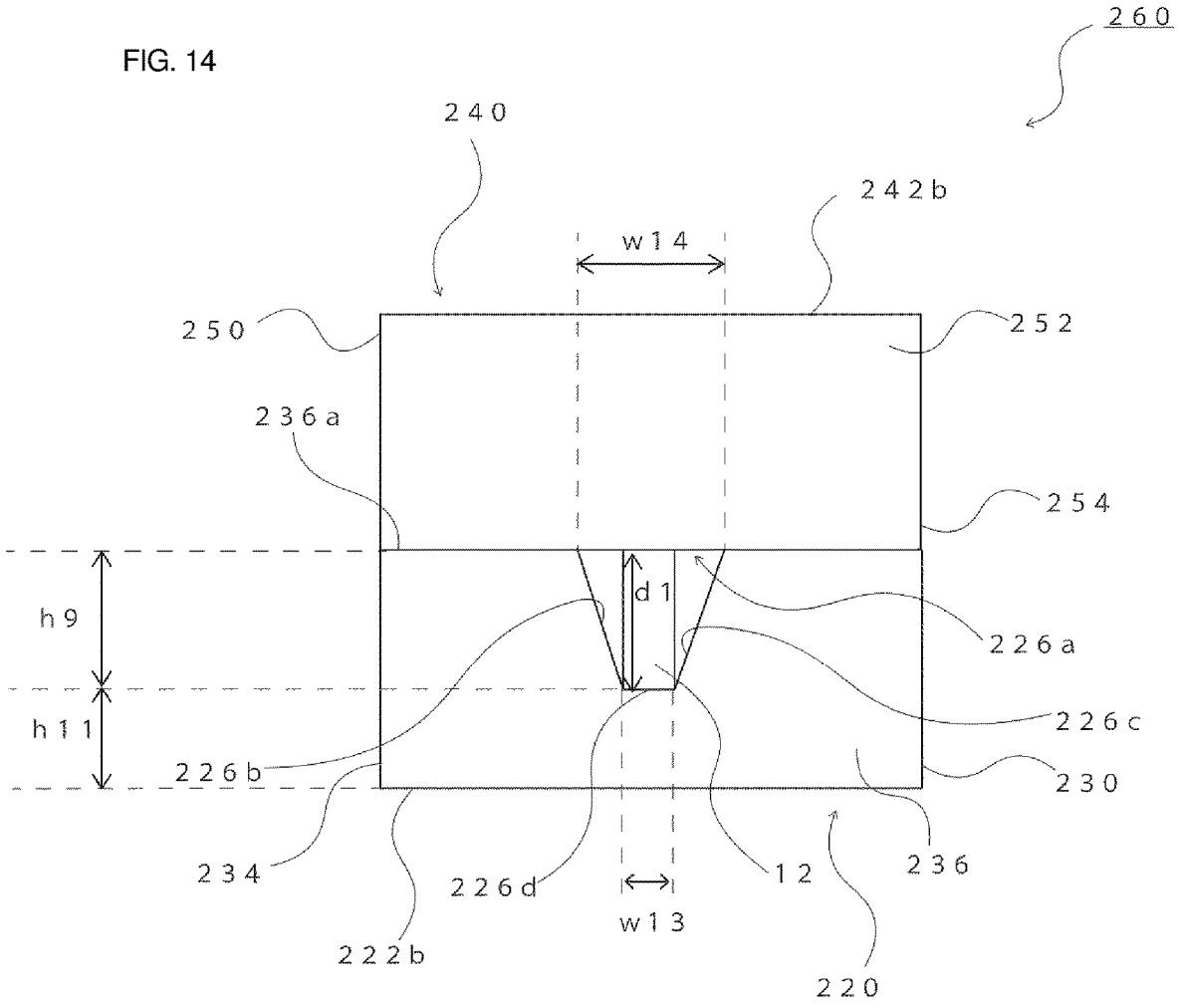
FIG. 14 is a side view in which the coil and an integrated preform formed through the assembly process depicted in FIG. 13 are seen from one side.
Figure 15:
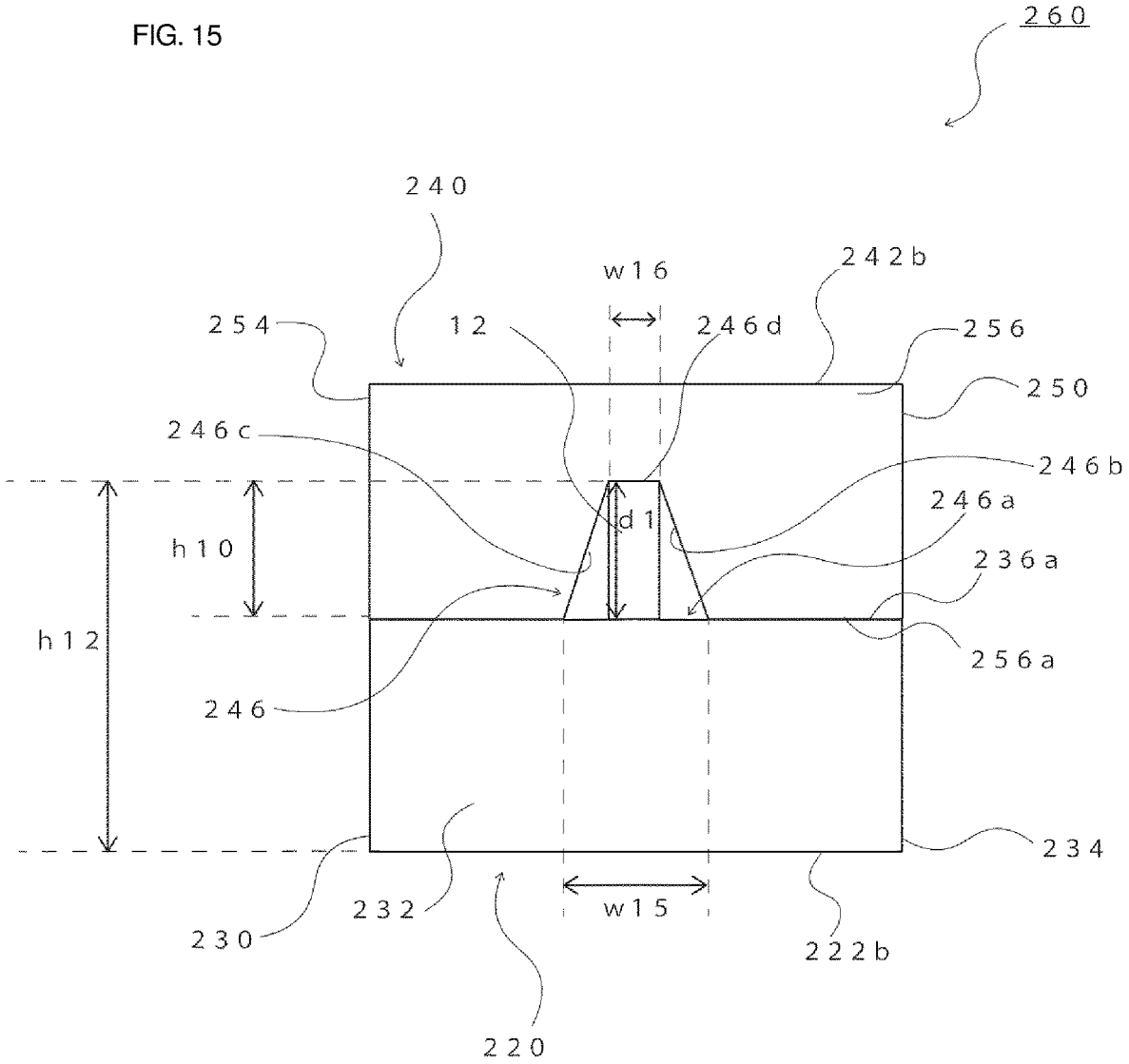
FIG. 15 is a side view in which the coil and the integrated preform formed through the assembly process depicted in FIG. 13 are seen from the other side.

Next, a first preform 220 and a second preform 240 according to embodiment 3 will be described while referring to FIGS. 12 to 15. The first preform 220 and the second preform 240 both have a substantially housing-like shape and have identical shapes. FIG. 12 is a perspective view illustrating the first preform 220 and the second preform 240 according to embodiment 3 of the present disclosure. FIG. 13 is an assembly perspective view for when the coil 6 is installed between the first preform 220 and the second preform 240 illustrated in FIG. 12. FIG. 14 is a side view in which the coil 6 and an integrated preform 260 formed through the assembly process depicted in FIG. 13 are seen from one side. FIG. 15 is a side view in which the coil 6 and the integrated preform 260 formed through the assembly process depicted in FIG. 13 are seen from the other side.

Embodiment 3 differs from embodiments 1 and 2 in that the first preform and the second preform have identical housing-like shapes. In embodiments 1 and 2, the coil is housed inside the first preform, whereas in embodiment 3, the coil is housed inside the first preform and the second preform.

First Preform

As illustrated in FIG. 12, the first preform 220 includes a substantially plate-shaped bottom portion 222, a substantially column-shaped winding axis portion 224 provided on a top surface 222*a* of the bottom portion 222, and four wall portions 230, 232, 234, and 236 that surround the winding axis portion 224 and are provided on the top surface 222*a* of the bottom portion 222. In one wall portion 236, a cut out portion (first cut out portion) 226, which has an opening 226*a*, is provided in a top surface 236*a* of the wall portion 236. A cross section of the winding axis portion 224 in a direction substantially perpendicular to a center axis B3 is a substantially ellipsoidal shape. The winding axis portion 224 tapers in a direction away from the bottom portion 222. In other words, the tip of the winding axis portion 224 is narrower than the base of the winding axis portion 224 that is connected to the bottom portion 222. A length of the base of the winding axis portion 224 in a short axis direction is for example 500 μm and a length of the base of the winding axis portion 224 in a long axis direction is for example 800 μm. In addition, a length of the tip of the winding axis portion 224 in the short axis direction is for example at least 40 μm smaller than the length of the base of the winding axis portion 224 in the short axis direction, and the length of the tip of the winding axis portion 224 in the long axis direction is for example also at least 40 μm smaller than the length of the base of the winding axis portion 224 in the long axis direction.

As illustrated in FIG. 14, the cut out portion 226 has a substantially trapezoidal shape in a side view. The cut out portion 226 is formed of two facing side surfaces 226*b* and 226*c* and one bottom surface 226*d*. The bottom surface 226*d* is substantially parallel to a bottom surface 222*b* of the bottom portion 222. A width w13 of the bottom surface 226*d* of the first cut out portion 226 is smaller than a width w14 of the opening 226*a* of the first cut out portion 226. The width w13 of the bottom surface 226*d* substantially matches the thickness of the conductive wire that forms the coil 6 and is for example 20-200 μm and the width w14 of the opening 226*a* is for example at least 40 μm larger than the width w13. A depth h9 of the cut out portion 226 substantially matches the length dl of the flat wire in the width direction of the flat wire. Here, the width of the cut out portion 226 corresponds to the length between the side surface 226*b* and the side surface 226*c*. The depth h9 of the cut out portion 226 corresponds to the length between the top surface 236*a* of the wall portion 236 and the bottom surface 226*d* of the cut out portion 226.

Second Preform

The second preform 240 has the same shape as the first preform 220. As illustrated in FIG. 12, the second preform 240 includes a substantially plate-shaped bottom portion 242, a substantially column-shaped winding axis portion 244 provided on a top surface 242*a* of the bottom portion 242, and four wall portions 250, 252, 254, and 256 that surround the winding axis portion 244 and are provided on the top surface 242*a* of the bottom portion 242. In one wall portion 256, a cut out portion (second cut out portion) 246, which has an opening 246*a*, is provided in a top surface 256*a* of the wall portion 256.

As illustrated in FIG. 13, the winding axis portion 224 of the first preform 220 and the winding axis portion 244 of the second preform 240 are made to face each other and the coil 6 is installed between the first preform 220 and the second preform 240. At this time, the cut out portion (first cut out portion) 226 and the cut out portion (second cut out portion) 246 are arranged on opposite sides with respect to the winding axis portions 224 and 244. The first preform 220 and the second preform 240 are bonded to each other with the coil 6 interposed therebetween and form the integrated preform 260. As illustrated in FIGS. 14 and 15, in the integrated preform 260, the difference between a first distance h11 from the bottom surface (reference surface) 222*b* of the bottom portion 222 to the bottom surface 226*d* of the first cut out portion 226 and a second distance h12 from the reference surface 222*b* to the bottom surface 246*d* of the second cut out portion 246 is substantially equal to twice the length dl of the flat wire in the width direction of the flat wire. In other words, in the integrated preform 260, the difference between the first distance h11 and the second distance h12 is substantially equal to twice the length dl of the flat wire in the width direction of the flat wire.

Effect

In the integrated preform 260, the difference between the first distance h11 and the second distance h12 is substantially equal to twice the length dl of the flat wire in the width direction of the flat wire. As a result, in the integrated preform 260, one extension portion 12 of the coil 6 is supported by the bottom surface 226*d* of the first cut out portion 226 and the other extension portion 10 is supported by the bottom surface 246*d* of the second cut out portion 246. In addition, in the integrated preform 260, a winding center axis C3 of the coil 6 substantially coincides with a vertical-direction center axis D3 of the integrated preform 260. Therefore, the accuracy with which the coil 6 is arranged in the integrated preform 260 can be increased by using the thus-configured first preform 220 and second preform 240, and variations in the characteristics of the completed inductor 1 can be effectively suppressed.

Furthermore, the thus-configured first preform 220 and second preform 240 have identical shapes. Therefore, the first preform 220 and the second preform 240 can be manufactured using the same mold, the manufacturing cost can be reduced, and the manufacturing steps can be simplified.

Modifications

In the above-described embodiments, the shapes of the first cut out portions 26, 126, and 226 and the second cut out portion 28, 128, 246 are substantially trapezoidal shapes that are symmetrical about lines that are substantially perpendicular to the bottom surfaces 26*d*, 126*d*, 226*d*, 28*d*, 128*d*, and 246*d* and bisect these bottom surface in a side view, but the shapes of the first cut out portions 26, 126, and 226 and the second cut out portions 28, 128, and 246 are not limited to these shapes. For example, the inclination angle of first side surfaces 26*b*, 126*b*, 226*b*, 28*b*, 128*b*, and 246*b* and the inclination angle of second side surfaces 26*c*, 126*c*, 226*c*, 28*c*, 128*c*, and 246*c* relative to the bottom surfaces 26*d*, 126*d*, 226*d*, 28*d*, 128*d*, and 246*d* may be different from each other. Furthermore, in the above-described embodiments, the surfaces constituting the side surfaces 26*b*, 26*c*, 126*b*, 126*c*, 226*b*, 226*c*, 28*b*, 28*c*, 128*b*, 128*c*, 246*b*, and 246*c* are flat but the side surfaces are not limited to this configuration. For example, the surfaces constituting the side surfaces 26*b*, 26*c*, 126*b*, 126*c*, 226*b*, 226*c*, 28*b*, 28*c*, 128*b*, 128*c*, 246*b*, and 246*c* may be curved surfaces.

Embodiments of the present disclosure have been described above, but the disclosed content may be changed in terms of the details of the configurations, and changes in the combinations and orders of elements and so forth in the embodiments can be made without departing from the scope and spirit of the claimed disclosures.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

an element body including an integrated preform having a coil installed thereinside;

wherein the coil includes a wound portion including a flat wire having a substantially rectangular cross section wound in a two-stage spiral shape, and extension portions that respectively extend from the two stages, the integrated preform includes a first preform and a second preform that are bonded together and both include a magnetic powder and a resin, at least one of the first preform and the second preform has a substantially housing shape that includes a substantially plate-shaped bottom portion, a wall portion that is provided around a periphery of the bottom portion, and cut out portions that are provided in the wall portion, the cut out portions are arranged in a pair in the integrated preform, at least part of each extension portion of the coil extends to outside the integrated preform via a corresponding one of the cut out portions, and a difference between a first distance from a reference surface, which is a bottom surface of the bottom portion of the first preform or the second preform, to a bottom surface of one cut out portion and a second distance from the reference surface to a bottom surface of the other cut out portion is substantially equal to an integer multiple of a length of the flat wire in a width direction of the flat wire.

2. The inductor according to claim 1, wherein the first preform has a substantially housing shape, the second preform has a substantially plate shape, a substantially column-shaped winding axis portion that is surrounded by the wall portion is arranged on the bottom portion of the first preform, and the difference between the first distance and the second distance is substantially equal to the length of the flat wire in the width direction of the flat wire.

3. The inductor according to claim 1, wherein the first preform has a substantially housing shape, the second preform includes a substantially plate shaped substrate, a substantially column-shaped winding axis portion is arranged on the substrate of the second preform, and the difference between the first distance and the second distance is substantially equal to the length of the flat wire in the width direction of the flat wire.

4. The inductor according to claim 1, wherein the first preform and the second preform are both substantially housing shaped, a substantially column-shaped winding axis portion that is surrounded by the wall portions is provided on the bottom portion of the first preform and on the bottom portion of the second preform respectively, and the difference between the first distance and the second distance is substantially equal to twice the length of the flat wire in a width direction of the flat wire.

5. The inductor according to claim 2, wherein the winding axis portion tapers in a direction away from the bottom portion of the first preform or the substrate of the second preform.

6. The inductor according to claim 1, wherein a width of the bottom surface of each cut out portion is smaller than a width of an opening of the cut out portion.

7. The inductor according to claim 1, wherein the width of the bottom surface of each cut out portion is substantially equal to a thickness of the flat wire.

8. The inductor according to claim 2, wherein the magnetic powder of the first preform is different from the magnetic powder of the second preform.

9. The inductor according to claim 3, wherein the winding axis portion tapers in a direction away from the bottom portion of the first preform or the substrate of the second preform.

10. The inductor according to claim 4, wherein
the winding axis portion tapers in a direction away from the bottom portion of the first preform or the substrate of the second preform.

11. The inductor according to claim 2, wherein
a width of the bottom surface of each cut out portion is smaller than a width of an opening of the cut out portion.

12. The inductor according to claim 3, wherein
a width of the bottom surface of each cut out portion is smaller than a width of an opening of the cut out portion.

13. The inductor according to claim 4, wherein
a width of the bottom surface of each cut out portion is smaller than a width of an opening of the cut out portion.

14. The inductor according to claim 5, wherein
a width of the bottom surface of each cut out portion is smaller than a width of an opening of the cut out portion.

15. The inductor according to claim 2, wherein
the width of the bottom surface of each cut out portion is substantially equal to a thickness of the flat wire.

16. The inductor according to claim 3, wherein
the width of the bottom surface of each cut out portion is substantially equal to a thickness of the flat wire.

17. The inductor according to claim 4, wherein
the width of the bottom surface of each cut out portion is substantially equal to a thickness of the flat wire.

18. The inductor according to claim 5, wherein
the width of the bottom surface of each cut out portion is substantially equal to a thickness of the flat wire.

19. The inductor according to claim 6, wherein
the width of the bottom surface of each cut out portion is substantially equal to a thickness of the flat wire.

20. The inductor according to claim 3, wherein
the magnetic powder of the first preform is different from the magnetic powder of the second preform.

* * * * *